US005842314A

United States Patent [19]

Porter

[11] Patent Number: 5,842,314

[45] Date of Patent: Dec. 1, 1998

[54] METAL REINFORCEMENT OF GYPSUM, CONCRETE OR CEMENT STRUCTURAL INSULATED PANELS

[76] Inventor: William H. Porter, P. O. Box 249, Saugatuck, Mich. 49453

[21] Appl. No.: 853,696

[22] Filed: May 8, 1997

[51] Int. Cl.[6] ..... E04C 1/00

[52] U.S. Cl. ..... 52/309.7

[58] Field of Search ..... 52/309.2, 309.7, 52/309.9, 592.1, 784.15, 787.1, 794.1, 790.1, 800.1, 801.1, 630, 309.4, 309.5, 309.12

[56] References Cited

U.S. PATENT DOCUMENTS

| | | | |
|---|---|---|---|
| 3,786,611 | 1/1974 | Brown et al. | 52/309.1 X |
| 4,125,984 | 11/1978 | Jonas | 52/238.1 X |
| 4,236,366 | 12/1980 | Rijnders | 52/580 |
| 4,283,898 | 8/1981 | Claver | 52/584.1 |
| 4,575,981 | 3/1986 | Porter | 52/309.9 |
| 5,014,476 | 5/1991 | Leslie et al. | 52/220 |
| 5,022,208 | 6/1991 | Ehrat et al. | 52/586 |
| 5,333,429 | 8/1994 | Cretti | 52/309.7 |
| 5,373,678 | 12/1994 | Hesser | 52/592.1 |
| 5,497,589 | 3/1996 | Porter | 52/309.7 |
| 5,524,400 | 6/1996 | Schmechel | 52/474 |
| 5,660,907 | 8/1997 | Skalka | 52/630 X |

*Primary Examiner*—Carl D. Friedman
*Assistant Examiner*—Beth A. Aubrey
*Attorney, Agent, or Firm*—Emrich & Dithmar

[57] ABSTRACT

A generally flat structural panel for building construction includes a center insulating core such as of foam and opposed outer facings, or sheets, with one or more metal strips disposed within and extending the length of the panel and bonded to the panel's insulating core and to one of its outer facings. At least one of the outer facings is composite gypsum, concrete or cement which provides good tensile strength and high fire, environmental and insect resistance as well as low cost, but only limited bending strength. Metal strips of either aluminum or steel incorporated in the panel and bonded to the insulating core and to the gypsum, concrete or cement facing extend substantially the entire length of the panel and substantially increase the panel's bending strength without noticeably increasing its weight, permitting the panel to be used as a loadbearing structural member such as in a roof or floor as well as an outer wall capable of withstanding wind loads and earth loads when used as a basement wall panel.

10 Claims, 2 Drawing Sheets

METAL REINFORCEMENT OF GYPSUM, CONCRETE OR CEMENT STRUCTURAL INSULATED PANELS

FIELD OF THE INVENTION

This invention relates generally to structural panels for buildings and is particularly directed to structural insulated panels having opposed outer facings and an insulating core which afford good tensile strength and further incorporating internal metal strips for high bending strength allowing the panels to be used in high load-bearing applications.

BACKGROUND OF THE INVENTION

Structural Insulated Panels (SIPs) are increasingly being used in building construction as an alternative to the stick built approach involving the use of the 2×dimensional structural lumber members and nails. The latter approach to building construction is slow and manpower intensive, requires a large supply of a limited commodity, and affords a limited number of structural shapes. The SIP construction approach employs a basic structural unit consisting of two rigid faces on either side of a light insulated foam core. High strength bonding of the outer faces to the inner core forms a structural I-beam in the form of flat panels which are typically joined together by lumber and nails. A more recent approach disclosed in applicant's U.S. Pat. No. 5,497,589 utilizes a structural insulated panel with metal edges disposed about and securely attached to a center foam core and outer opposed facings affixed to the center core. The metal strip around the peripheral edge of the panel increases the strength of the panel, facilitates panel connection to adjacent, similar panels and other structural members, and reduces heat transfer between the surfaces of a wall formed of a plurality of such panels.

The present invention represents another approach to the use of structural insulated panels in building construction. The structural insulated panels of the present invention incorporate at least one outer facing comprised of gypsum, concrete or cement affording high tensile strength and a plurality of inner metal strips attached to the panel's inner foam core and to the gypsum, concrete or cement facing to provide the panel with high bending strength also. Structural insulated panels in accordance with the present invention can be used as load-bearing structural members such as roofs and floors, as well as wall panels capable of withstanding high wind loading or earth loads when used as a basement wall panel.

OBJECTS AND SUMMARY OF THE INVENTION

Accordingly it is an object of the present invention to provide a high strength, lightweight, structural insulated panel for buildings which is fire-, insect-, and environmentally-resistant.

It is another object of the present invention to provide a high strength composite gypsum or cement structural insulated panel reinforced with metal strips to provide both high tensile strength and high bending strength.

Yet another object of the present invention is to provide a laminated structural insulated panel having high bending strength for use in high load bearing applications.

The present invention contemplates an insulated structural panel comprising a generally flat insulating core; first and second outer facings attached to opposed lateral surfaces of the insulating core, wherein the first outer facing is of gypsum, concrete or cement; and at least one linear, elongated metal strip disposed between and attached to the insulating core and the first outer facing and extending substantially the length of the panel for increasing the bending strength of the panel.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
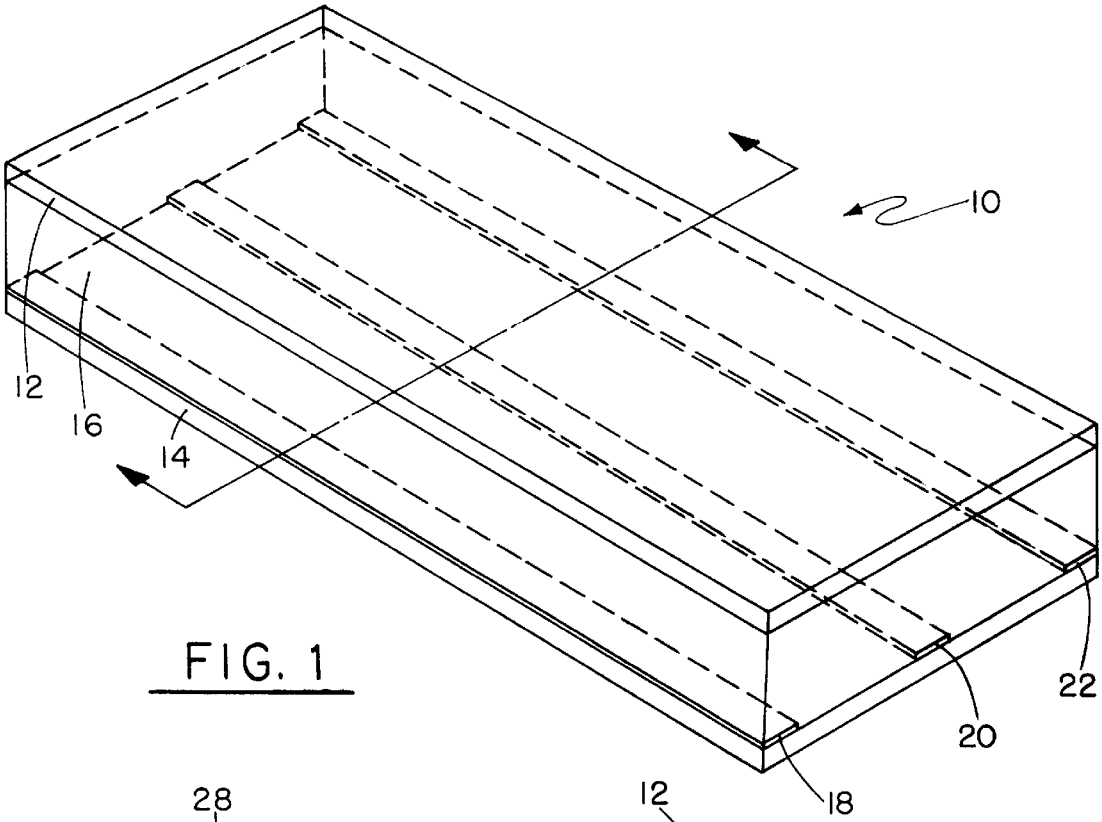
FIG. 1 is a perspective view shown partially in phantom of a gypsum or cement faced structural insulated panel having metal reinforcing strips in accordance with the principles of the present invention.
Figure 2:
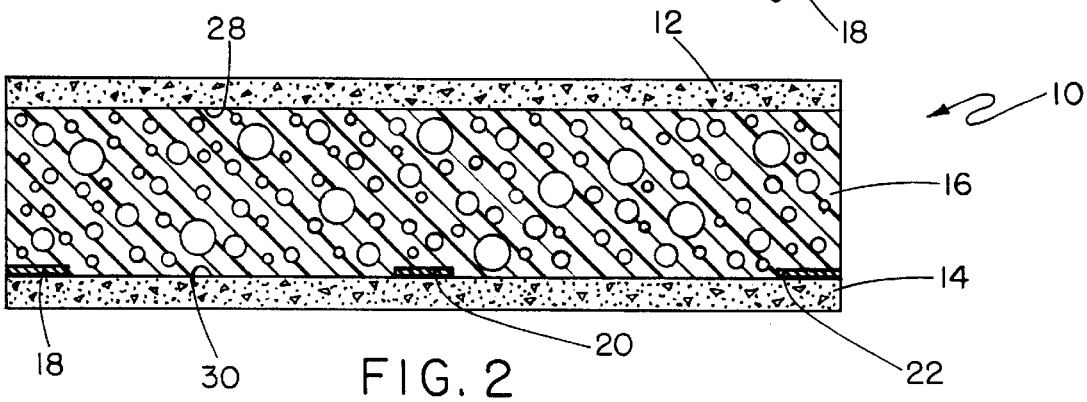
FIG. 2 is a sectional view of the structural insulated panel of FIG. 1 taken along site line 2—2 therein.
Figure 2A:
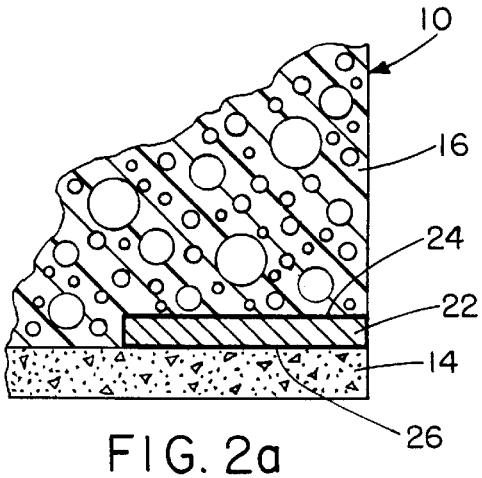
FIG. 2*a* is a partial sectional view of the structural insulated panel shown in FIGS. 1 and 2 illustrating details of the metal reinforcing strip installation in the panel.

Referring to FIG. 1, there is shown partially in phantom a perspective view of an insulated, metal reinforced structural panel 10 in accordance with the present invention. A sectional view of the structural panel 10 shown in FIG. 1 taken along site line 2—2 therein is shown in FIG. 2. A partial sectional view of the structural panel 10 shown in FIGS. 1 and 2 illustrating details of the manner in which a reinforcing metal strip 22 is incorporated in the panel is shown in the partial sectional view of FIG. 2*a*.

Structural panel 10 includes first and second outer facings 12 and 14 disposed on and affixed to opposed outer surfaces of a generally planar, insulating core 16. Structural panel 10 is shown as generally rectangular in shape, but may assume virtually any of the more common shapes assumed by structural panels in building construction. Insulating core 16 is preferably comprised of a plastic foam such as of expanded polystyrene or urethane and is securely affixed to the first and second outer facings 12,14 by respective adhesive layers 28 and 30. Adhesive layers 20,30 are comprised of any of the more common adhesive materials such as urethane cement or glue. At least one of the outer facings is comprised of composite gypsum, concrete or cement. The other outer facing may also be comprised of gypsum, concrete or cement, or may be comprised of other generally used construction materials such as wood or oriented strand board (OSB). Thus, if in FIG. 2 the second outer facing 14 is of gypsum, concrete or cement, the first outer facing 12 may also be of either gypsum, concrete or cement, or may be comprised of wood or OSB.

In accordance with the present invention, first, second and third metal reinforcing strips 18,20 and 22 are disposed in a spaced manner within the metal reinforced structural panel 10 and extend substantially the length of the panel. Each of the first, second and third metal reinforcing strips 18,20 and 22 is disposed between and affixed to the panel's insulating core 16 and to the outer facing which is comprised of gypsum, concrete or cement, which in the present case is the panel's second outer facing 14. Each of the metal reinforcing strips 18,20 and 22 is affixed at the insulating core 16 and the second outer facing 14 by means of first and second adhesive layers 24 and 26 as shown for the case of the third metal reinforcing strip 22 in the partial sectional view of FIG. 2*a*. Again, adhesive layers 24,26 may be comprised of any of the more conventional adhesive materials such as urethane cement or glue. Metal reinforcing strips 18,20 and 22 are arranged in a spaced manner over the width of the insulated structural panel 10 and substantially increase the bending strength of the panel particularly along its length. Insulated structural panels incorporating metal reinforcing strips in accordance with the present invention exhibit an increase in bending strength on the order of 40% over non-reinforced structural panels. For maximum strength, the metal reinforcing strips are preferably affixed to an outer facing of the structural insulated panel which is comprised of either gypsum, concrete or cement. Moreover, the metal reinforcing strip is preferably affixed to the outer facing of the panel opposite to the outer facing to which a load is applied as described below.

Figure 3:
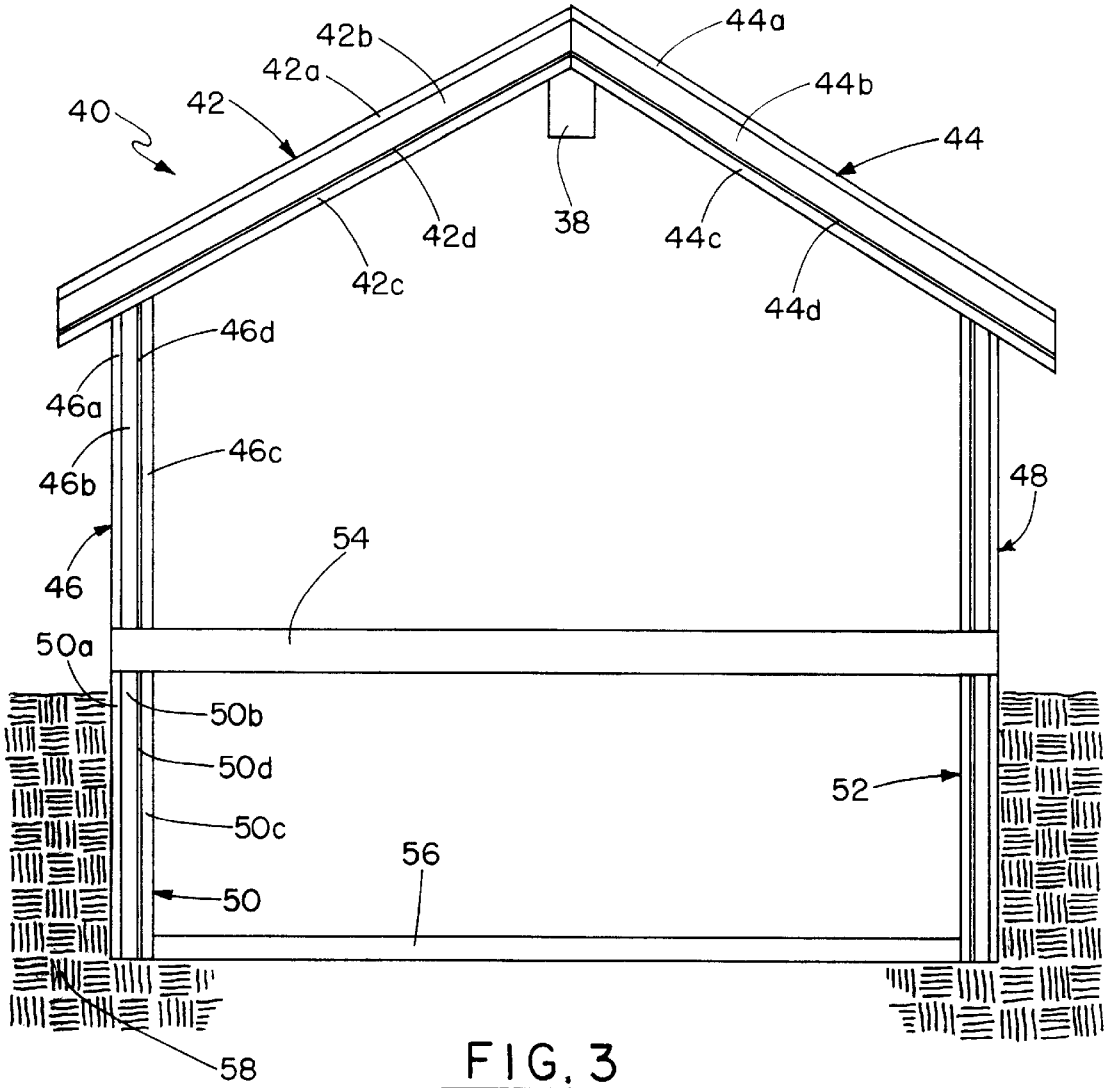
FIG. 3 is a simplified sectional view of a building structure incorporating gypsum, concrete or cement faced structural insulated panels reinforced with metal strips in accordance with the present invention as various structural elements in the building.

Referring to FIG. 3, there is shown a simplified sectional view of a building structure 40 incorporating insulated structural panels in accordance with the present invention. Building structure 40 includes first and second roof panels 42 and 44 respectively coupled to and supported by first and second wall panels 46 and 48 as well as by a roof beam 38. As in the previously described insulated, metal reinforced structural panel, the first roof panel 42 includes first and second outer facings 42*a* and 42*c*, an inner insulating core 42*b*, and one or more metal reinforcing strips 42*d*. Similarly, the second roof panel 44 includes first and second outer facings 44*a* and 44*c*, an inner insulating core 44*b*, and one or more inner metal reinforcing strips 44*d*. The second outer facings of 42*c* and 44*c* of the first and second roof panels 42,44 are comprised of gypsum, concrete or cement. Each of the metal reinforcing strips 42*d* is disposed in contact with and affixed to the first roof panel's insulating core 42*b* as well as to its inner facing 42*c*. Similarly, each of the metal reinforcing strips 42*d* is disposed in contact with and affixed to the second roof panel's inner insulating core 44*b* and to its inner facing 44*c*. A first wall panel 46 in the building structure 40 includes an outer facing 46*a*, an insulating core 46*b*, one or more metal reinforcing strips 46*d* and an inner facing 46*c*. A similarly configured second wall panel 48 is disposed on the opposed outer portion of the building structure 40. Each of the first and second wall panels 46,48 is adapted to withstand large wind loads because of the metal reinforcing strips disposed therein. Again, the metal reinforcing strips are bonded to the respective inner facings of the first and second wall panels 46,48, or opposite to the surface of the panel on which the wind load is exerted, for maximum bending strength. First and second wail panels 46,48 are supported by a floor 54.

Building structure 40 further includes first and second basement panels 50 and 52 which are similarly configured and sized. The first basement panel 50 includes an outer facing 50*a*, an inner insulating core 50*b*, at least one metal reinforcing strip 50*d*, and an inner facing 50*c*. Each of the first and second basement panels 50,52 is capable of withstanding a large load exerted by surrounding soil 58. The building structure 40 further includes a foundation floor 56 disposed between and attached to the first and second basement panels 50,52.

Figure 4:
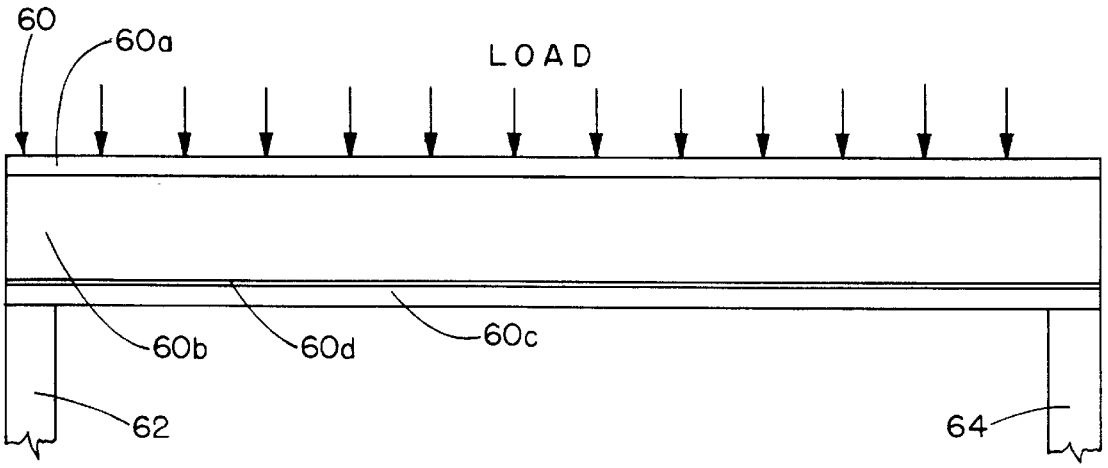
FIG. 4 is a simplified side elevation view of a gypsum, concrete or cement faced structural insulated panel with metal reinforcing strips shown as used in a floor application.

Referring to FIG. 4, there is shown a side elevation view of a floor panel 60 in accordance with the present invention attached to and supported by first and second support members 62 and 64. The floor panel 60 includes upper and lower outer facings 60*a* and 60*c*. Disposed intermediate and bonded to the upper and lower outer facings 60*a*,60*d* is an inner insulating core 60*b*. Disposed intermediate and bonded to the insulating core 60*b* and lower outer facing 60*d* is at least one metal reinforcing strip 60*d*. As in the previously described panels, metal reinforcing strip 60*d* is disposed in contact with and affixed to the panel's insulating core 60*b* and its lower outer facing 60*c*. A load is applied to the floor panel 60 in the direction of the arrows in the figure. For maximum strength, the panel's lower outer facing 60*d* is comprised of gypsum, concrete or cement and is bonded to the metal reinforcing strip 60*d* within the panel.

There has thus been shown a structural insulated panel having an insulating foam core and first and second outer facings. At least one of the outer facings is comprised of gypsum, concrete or cement. The panel further includes one or more metal strips disposed between and affixed to the panel's insulating core and the outer facing comprised of gypsum, concrete or cement. The gypsum, concrete or cement outer facing provides the panel with high tensile strength and the inner metal strips provide the panel with high bending strength without substantially increasing panel weight. The metal strips and gypsum, concrete or cement outer facing are preferably disposed opposite to the surface of the panel to which a load is applied for maximum strength. The metal strips provide an increase in bending strength of the panel on the order of 40% over the strength of non-reinforced panels.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An insulated structural panel comprising;

a generally flat insulating core;

first and second outer facings attached to opposed lateral surfaces of said insulating core, wherein said first outer facing is of gypsum, concrete or cement;

at least one linear, elongated, generally planar metal strip disposed entirely within the panel and between said insulating core and said first outer facing and extending substantially the length of said panel, wherein said at least one metal strip is generally rectangular in cross section and includes first and second opposed outer surfaces, and wherein said entire first outer surface engages said insulating core and said entire second outer surface engages said first outer facing; and an adhesive attaching said at least one metal strip to said insulating core and said first outer facing for increasing the bending strength of the panel.

2. The insulated structural panel of claim 1 wherein said insulating core is plastic foam.

3. The insulated structural panel of claim 2 wherein said plastic foam is expanded polystyrene or urethane.

4. The insulated structural panel of claim 1 wherein said adhesive is urethane cement or glue.

5. The insulated structural panel of claim 1 wherein said at least one metal strip is aluminum or steel.

6. The insulated structural panel of claim 1 wherein said second outer facing is of gypsum, concrete or cement.

7. The insulated structural panel of claim 1 wherein said second outer facing is wood or oriented strand board.

8. The insulated structural panel of claim 1 wherein said at least one metal strip is thin and elongated in shape.

9. The insulated structural panel of claim 1 wherein said at least one metal strip and said first outer facing are disposed in spaced relation from a surface of the panel to which a load is applied.

10. An insulated load bearing panel for use in building construction, said panel comprising;

a generally planar insulating core having first and second opposed sides;

first and second outer facings respectively attached to said first and second opposed sides of said insulating core, wherein said second outer facing is gypsum, concrete or cement and wherein a load is applied to said first outer facing generally transverse: to said planar insulating core;

a plurality of linear, elongated, generally flat metal strips each disposed entirely within the panel and between said insulating core and said second outer facing for withstanding the load applied to said first outer facing, wherein said metal strips are arranged in a spaced manner over the width of the panel and extend substantially the entire length of the panel and wherein each metal strip has generally rectangular cross section and includes respective first and second opposed outer surfaces, wherein said entire first surface and said entire second surface of each of said metal strips (are) respectively engage said insulating core and said second outer facing; and an adhesive attaching said metal strips to said insulating core and said second outer facing for increasing the bending strength of the panel.

* * * * *

UNITED STATES PATENT AND TRADEMARK OFFICE

CERTIFICATE OF CORRECTION

PATENT NO. : 5,842,314

DATED : 12/1/98

INVENTOR(S) : WILLIAM H. PORTER

It is certified that error appears in the above-indentified patent and that said Letters Patent is hereby corrected as shown below:

| COLUMN | LINE | |
|---|---|---|
| 4 | 9 | "60a,60d" should be — 60a,60c —. |
| 4 | 11 | "60d" should be — 60c —. |
| 4 | 17 | "facing 60d" should be — facing 60c —. |
| 6 | 15 | (are) should have been omitted from the text. |

Signed and Sealed this

Sixteenth Day of March, 1999

*Attest:*

Q. TODD DICKINSON

*Attesting Officer*

*Acting Commissioner of Patents and Trademarks*